US009169607B2

(12) United States Patent
Schweizer et al.

(10) Patent No.: US 9,169,607 B2
(45) Date of Patent: Oct. 27, 2015

(54) SYSTEM AND METHOD FOR INTEGRALLY ILLUMINATED PAVING ENCLOSURE CONSTRUCTION AND USE

(75) Inventors: Russell Schweizer, Crystal Lake, IL (US); Jimmy Wan Chi Hung, Tsimshatsui (HK)

(73) Assignee: Exim8, Inc., Crystal Lake, IL (US)

( * ) Notice: Subject to any disclaimer, the term of this patent is extended or adjusted under 35 U.S.C. 154(b) by 0 days.

(21) Appl. No.: 13/417,938

(22) Filed: Mar. 12, 2012

(65) Prior Publication Data

US 2012/0262911 A1 Oct. 18, 2012

Related U.S. Application Data

(60) Provisional application No. 61/464,798, filed on Mar. 10, 2011.

(51) Int. Cl.

| | |
|---|---|
| ***F21V 21/02*** | (2006.01) |
| ***E01F 9/06*** | (2006.01) |
| ***F21V 33/00*** | (2006.01) |
| ***F21S 8/02*** | (2006.01) |
| ***F21S 9/03*** | (2006.01) |
| ***E01C 17/00*** | (2006.01) |
| *F21W 111/023* | (2006.01) |
| *F21Y 101/02* | (2006.01) |
| *E04B 5/46* | (2006.01) |
| *F21V 23/04* | (2006.01) |
| *F21Y 105/00* | (2006.01) |

(52) U.S. Cl.

CPC ..... *E01F 9/065* (2013.01); *E01C 17/00* (2013.01); *F21S 8/022* (2013.01); *F21S 9/037* (2013.01); *F21V 33/006* (2013.01); *E04B 5/46* (2013.01); *F21V 23/0464* (2013.01); *F21W 2111/023* (2013.01); *F21Y 2101/02* (2013.01); *F21Y 2105/001* (2013.01)

(58) Field of Classification Search

CPC ..... F21V 21/04; F21V 21/02; F21V 33/006; F21S 8/022; F21S 8/028; F21S 8/03

USPC ..... 362/364–366

See application file for complete search history.

(56) References Cited

U.S. PATENT DOCUMENTS

| | | | | |
|---|---|---|---|---|
| 2,216,220 A | | 10/1940 | Baker | |
| 4,223,377 A | * | 9/1980 | Williams | 362/145 |
| 4,303,969 A | | 12/1981 | Hamilton | |
| 6,027,280 A | * | 2/2000 | Conners et al. | 404/19 |
| 6,082,886 A | | 7/2000 | Stanford | |

(Continued)

OTHER PUBLICATIONS

PCT Notification of Transmittal of the International Search Report and the Written Opinion of the International Searching Authority, or the Declaration, in International application No. PCT/US2012/028767, dated Jun. 27, 2012 (8 pages).

*Primary Examiner* — Julie Bannan

(74) *Attorney, Agent, or Firm* — Miller, Matthias & Hull LLP

(57) ABSTRACT

An internally illuminated enclosure for a walkway or driveway is provided. The internally illuminated enclosure includes solar panel converting sunlight to electricity which is stored in a rechargeable battery. When a low-light situation is detected by an ambient light sensor, a control circuit provides power from the rechargeable batters to LEDs. Additionally, the internally illuminated enclosure includes a two-part placesetting system having a permanently installed portion and a removable portion.

17 Claims, 8 Drawing Sheets

(56) References Cited

U.S. PATENT DOCUMENTS

| | | | | |
|---|---|---|---|---|
| 6,116,751 | A * | 9/2000 | Remp | 362/153 |
| 6,705,797 | B1 * | 3/2004 | Wada | 404/38 |
| 6,755,550 | B1 * | 6/2004 | Lackey | 362/147 |
| 7,070,294 | B2 * | 7/2006 | Patti | 362/153.1 |
| 8,235,542 | B2 * | 8/2012 | Yohananoff | 362/153.1 |
| 2006/0092630 | A1 * | 5/2006 | Kennedy et al. | 362/157 |
| 2008/0272278 | A1 * | 11/2008 | Shewa et al. | 250/206 |

* cited by examiner

SYSTEM AND METHOD FOR INTEGRALLY ILLUMINATED PAVING ENCLOSURE CONSTRUCTION AND USE

CROSS-REFERENCE TO RELATED APPLICATIONS

The present application claims the benefit of U.S. Provisional Application No. 61/464,798, filed Mar. 10, 2011, entitled "Internally Illuminated Walkway and Driveway Paving Enclosure with Secondary Base and Method of Construction and Installation".

BACKGROUND OF THE INVENTION

The present invention generally relates to lighting for walkways or driveways. More particularly, the present invention relates to a solar-powered illuminated system for walkways or driveways.

Currently, many walking and driving surfaces are constructed of stone or brick, commonly called Pavers or Paver stones. In many situations a property owner or architect, or independent Do-it-Yourself homeowner, might chose a Paver construction for the visual attributes it affords, or as a material decision based on climate and terrain, or as based on cost. This type of surface is also known as a cobblestone surface, a term used many years ago. Like a common brick or stone wall might be made be stacking multiple bricks and affixing them together integrally in a vertical plane, with mortar, or a sand aggregate material, a Paver surface is constructed in a similar manner in a horizontal plane by abutting multiple bricks or stones on a base foundation in a level or sloped fashion. This type of surface is typically considered a permanent construction as evidenced by the longevity of many cobblestone roadways still in existence decades after their construction. In Northern climates where low temperatures and ground frost exists, Paver installations are typically made using loose sand products that may retain grade and stone interlock, while enduring terrain movement through freeze and thaw cycles. In southern temperature zones with little or no frost concerns, Pavers may be installed using concrete and mortar type products. For either method of construction it is difficult and not advised to attempt to remove and replace an individual brick within the matrix. And as these constructions are considered to be permanent, due to the materials used, it is not common to remove and/or replace individual brick elements unless there is damage and repair is necessary.

The typical Paver construction comprises individual bricks that are either cut natural rock and stone, or kiln prepared terra cotta material in the form of a brick, or man made fabricated concrete bricks and stones. Some standard sizes exist in the category, however many custom styles and shapes are also readily available.

BRIEF SUMMARY OF THE INVENTION

One or more of the embodiments of the present invention provide an internally illuminated enclosure for a walkway or driveway. The internally illuminated enclosure includes solar panel converting sunlight to electricity which is stored in a rechargeable battery. When a low-light situation is detected by an ambient light sensor, a control circuit provides power from the rechargeable batters to LEDs. Additionally, the internally illuminated enclosure includes a two-part placesetting system having a permanently installed portion and a removable portion.

DETAILED DESCRIPTION OF THE INVENTION

Figure 1:
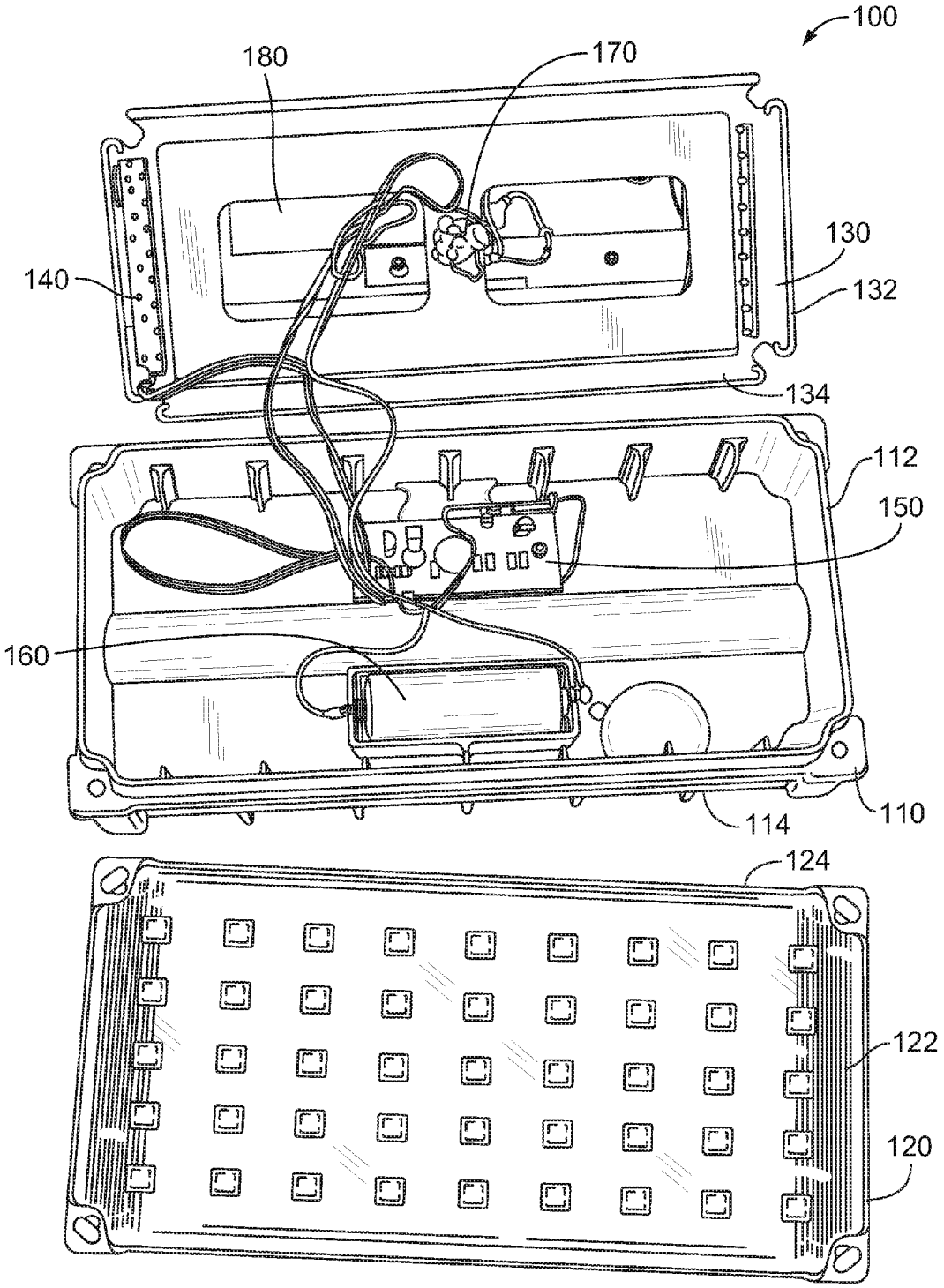
FIG. 1 illustrates an exploded view of an internally illuminated enclosure according to a preferred embodiment of the present invention.

FIG. 1 illustrates an exploded view of an internally illuminated enclosure 100 according to a preferred embodiment of the present invention. The internally illuminated enclosure 100 includes a primary base 110, a primary top 120, a top sub frame 130, LED lighting elements 140, a control circuit 150, a rechargeable battery 160, ambient light sensor 170 and a solar cell 180.

As further illustrated below, the solar cell 180 is connected to the rechargeable battery 160 which provides power to the LED lighting elements 140, the ambient light sensor, and the control circuit 150. The control circuit 150 also receives a signal from the ambient light sensor 170 with regard to the level of ambient light.

Also, as further illustrated below, the exterior edges 132, 134 of the top sub frame 130 are positionable inside the retaining edges 112, 114 of the primary base 110 in order to install the top sub frame 130 into the primary base 110. Additionally, once the top sub frame 130 has been installed into the primary base 110, the exterior edges 122, 124 of the primary top 120 fit around the perimeter of the retaining edges 112, 114 of the primary base 110 in order to install the primary top 120 into the primary base 110.

In operation, as further described below, the internally illuminated enclosure 100 may installed as one of the paving stones in a walkway. Once installed, during the day sunlight passes through the preferably optically clear, and at least translucent, primary top 120. The sunlight then impinges upon the solar cell 180 where the sunlight is transformed into electricity. The resultant electricity is then passed to the rechargeable battery 160 where it is stored.

The solar cell 180 continues to convert sunlight to electricity and the electricity continues to be stored during the day. At some point, the ambient light sensor 170 detects a decrease in ambient light and relays the detection to the control circuit 150. When the control circuit 150 receives an indication of the decrease in ambient light, such as when nightfall occurs, the control circuit causes power to flow from the rechargeable battery 160 to the LED lighting elements 140.

The LED lighting elements 140 are positioned near the sides of the internally illuminated enclosure 100 as shown in FIG. 1. Once the LED lighting elements 140 are initiated, the light produced by the lighting elements reflects and refracts around the interior of the primary top and a portion of the light emerges through the primary top. The portion of light that emerges from the primary top 120 illuminates the primary top and surrounding paving bricks so that a walkway including the internally illuminated enclosure 100 is sufficiently illuminated.

It is noted that FIG. 1 illustrates the bottom view of the top sub frame 130, and the top view of the primary base 110 and primary top 120.

Additionally, it is noted that the control circuit 150 may regulate battery charge and discharge. For example, the control circuit 150 may monitor the rechargeable battery 160. If the control circuit 150 detects that the rechargeable battery is fully charged, the control circuit 150 may cause the solar panel to cease providing electricity to the rechargeable battery 160.

Additionally, the control circuit 150 may regulated LED on and off cycling based on light sensor value. For example, in addition to simply turning the LEDs on or off by providing power to the LEDs, the control circuit 150 may choose to cycle the LEDs on and off based on the ambient light reading. For example, if the ambient light reading is dimmer than typical for the day, but not quite as dark as night, the control circuit 150 may cycle the LEDs on and off starting with an initial low duty cycle and then increasing the duty cycle as increasing dimness is detected.

Alternatively, the control circuit 150 may provide a variable level of light by providing a first level of power to the LEDs at a first level of detected dimness and then providing a second greater level of power to the LEDs at a second, darker level of detected dimness.

Alternatively, the control circuit 150 may choose to activate fewer than all of the available LEDs depending on the detected ambient light conditions. For example, at a first level of ambient light, the control circuit 150 may choose to power two of six LEDs. At a next, darker light level, four LEDs may be employed. Finally, at night, all six LEDs may be powered.

Additionally, the lighting control strategies mentioned above of cycling the LEDs, providing differing power levels to LEDs, and lighting only subsets of the available LEDs may all be provided together by the control circuit 150.

Figure 2:
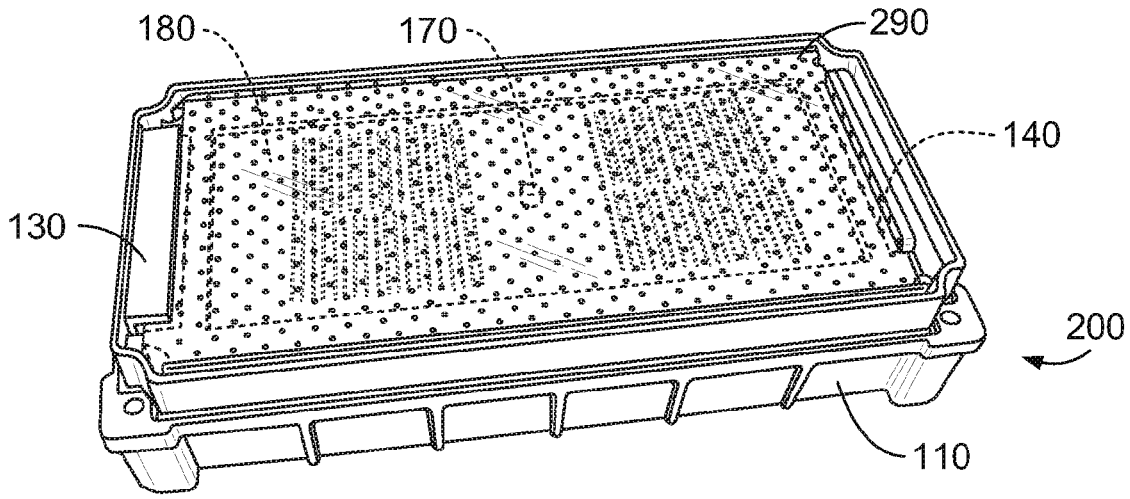
FIG. 2 illustrates the top sub frame installed in the primary base.

FIG. 2 illustrates the top sub frame 130 installed in the primary base 110. As shown in FIG. 2, the top sub frame 130 has been introduced into the primary base 110 so that the exterior edges 132, 134 of the top sub frame 130 are positioned inside the retaining edges 112, 114 of the primary base 110.

Additionally, FIG. 2 illustrates a top view of the top sub frame 130 showing the ambient light sensor 170 and the solar cell 180.

Additionally, FIG. 2 illustrates a top internal optic 290. The top internal optic 290 is preferably an optically clear, or at least translucent, element with intermittent surface roughening to increase light refraction and dispersion from the LEDs 140.

Figure 3:
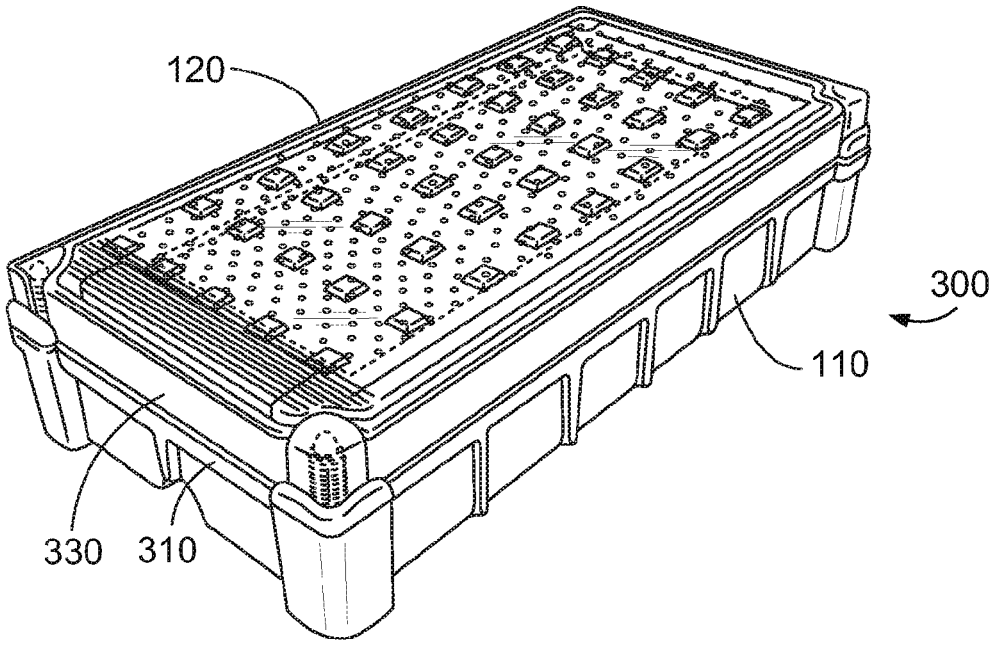
FIG. 3 illustrates the internally illuminated enclosure with the top sub frame installed into the primary base and the primary top also installed into the primary base.

FIG. 3 illustrates the internally illuminated enclosure 100 with the top sub frame 130 installed into the primary base 110 and the primary top 120 also installed into the primary base 110. As shown in FIG. 3, the primary top 120 fits over and around the upper edges of the primary base 110 to form a lid for the internally illuminated enclosure 110.

In addition, when installed the lowest portion of the primary top 120 rests on a lip 310 provided in the primary base 110. This provides a preferably leakproof moisture seal 330 around the perimeter of the primary base 110.

Figure 4:
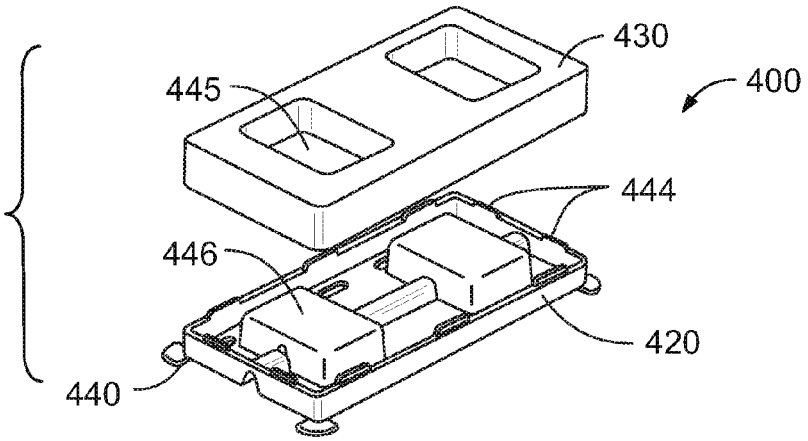
FIGS. 4-5 illustrates a placesetter.
Figure 5:
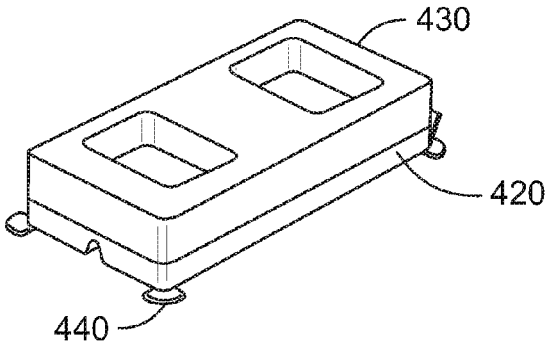

FIGS. 4-5 illustrates a placesetter 400. The placesetter 400 includes a placesetter base 420 and a placesetter top 430. In operation the placesetter top 430 is installed over the placesetter base 420 to form the placesetter 400. More specifically, the bottom edge of the exterior perimeter of the placesetter top is placed in contact with the top edge of the exterior perimeter of the placesetter base 420. Additionally, small tabs 444 extend upwardly from the placesetter base 420 and are received into the placesetter top. Additionally, the indents 445 in the placesetter top also come to rest on the center protrusions 446 of the placesetter base 420.

The placesetter 400 is shaped to be the size of a paver stone and then is positioned in the assembly of paver stones forming the walkway, as further illustrated below.

Additionally, the placesetter 400 includes corner mounting tabs 440. The corner mounting tabs 440 are preferably positioned under neighboring pavers in order to more securely fix the placesetter into the assembly of paver stones.

Figure 6:
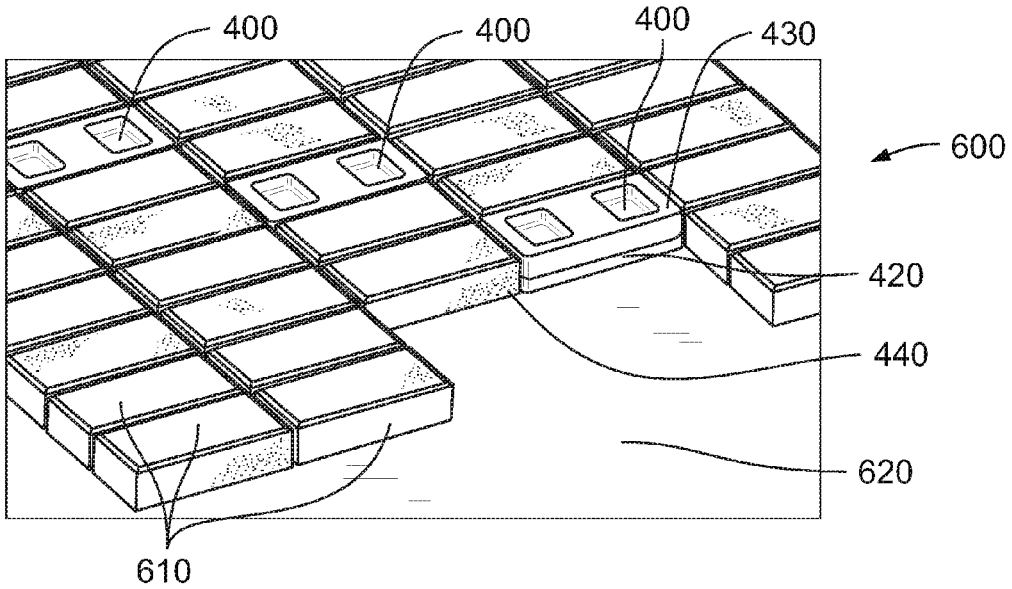
FIG. 6 illustrates a plurality of placesetters installed into an assembly of paving stones forming a walkway.

FIG. 6 illustrates a plurality of placesetters 400 installed into an assembly of paving stones forming a walkway 600. FIG. 6 also shows masonry bricks 610 and a sand base 620.

As seen in FIG. 6, the placesetters 400 may be installed in the walkway 600 in any desired pattern. The placesetters 400 are installed similarly to the masonry bricks 610 with the addition that the corner mounting tabs 440 are positioned under the neighboring masonry bricks.

In operation, the placesetter 400 is designed to be permanently set into the walkway 600 like any other masonry brick 610. More specifically, as further illustrated below, after installation of the placesetter 400, the placesetter top 430 may be later removed and replaced with the internally illuminated enclosure 100 of FIG. 1. However, although the placesetter top is removed, the placesetter base 420 remains fixed in the array of masonry bricks and receives and anchors the internally illuminated enclosure 100 into the walkway 600.

Figure 7:
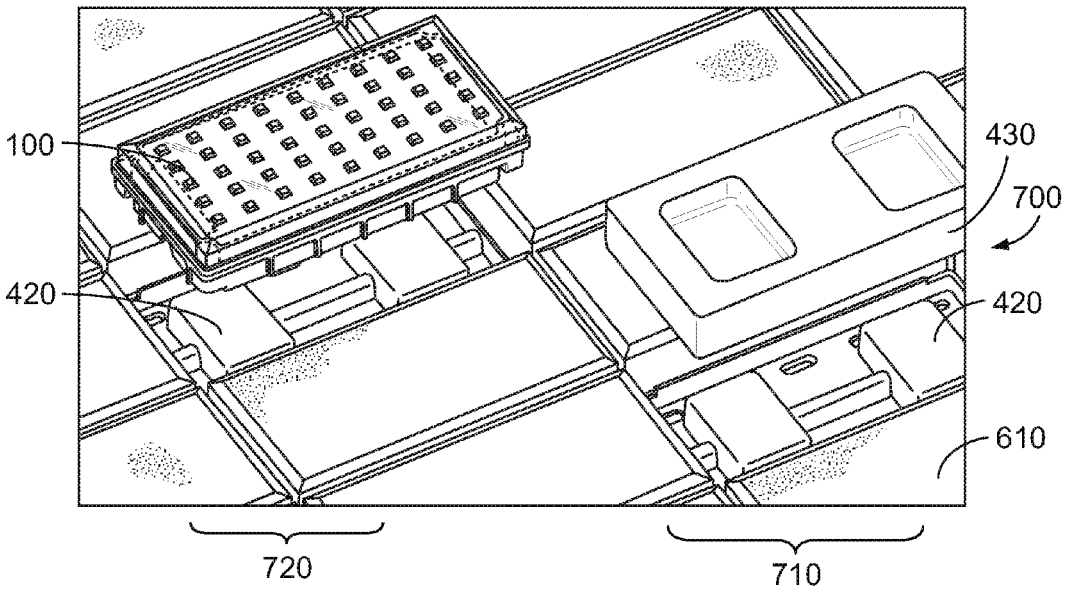
FIG. 7 illustrates the removal of the placesetter top from the placesetter base and replacement with the internally illuminated enclosure after installation into the walkway.

FIG. 7 illustrates the removal of the placesetter top 430 from the placesetter base 420 and replacement with the internally illuminated enclosure 100 after installation into the walkway. More specifically, at a first placesetter location 710, the placesetter base 420 is seen to remain fixed in the masonry bricks 610, while the placesetter top 430 has been removed.

At the second placesetter location 720, the placesetter top that had been previously positioned over the placesetter base 420 is gone and an internally illuminated enclosure 100 is shown being introduced into the placesetter base 420. The placesetter base 420 then engages with the bottom of the internally illuminated enclosure 100 to hold it as part of the walkway.

Figure 8:
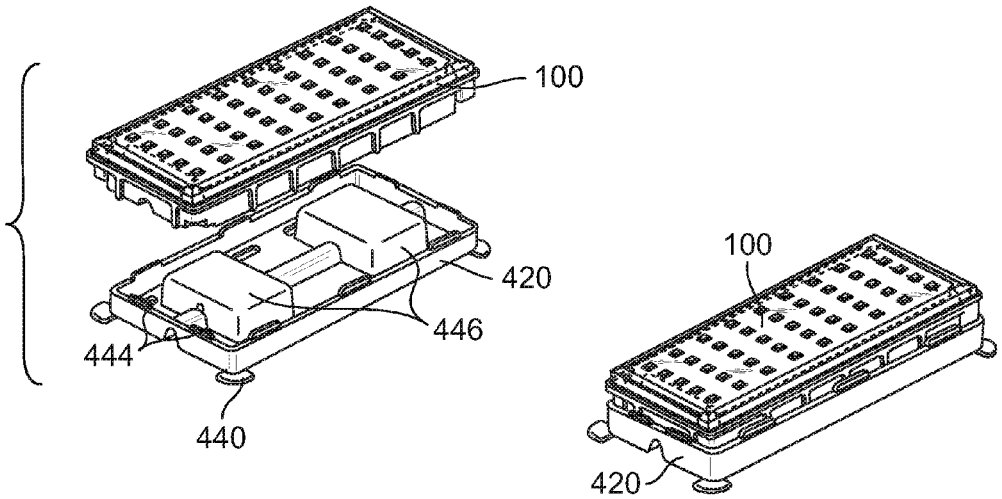
FIG. 8 illustrates an internally illuminated enclosure being installed into a placesetter base.

FIG. 8 illustrates an internally illuminated enclosure 100 being installed into a placesetter base 420. Additionally, as shown in FIG. 8, the small tabs 444 extending upward from the placesetter base 420 engage the internally illuminated enclosure 100. Also, the internally illuminated enclosure 100 is supported by the center protrusions 446 of the placesetter base 420.

Figure 9:
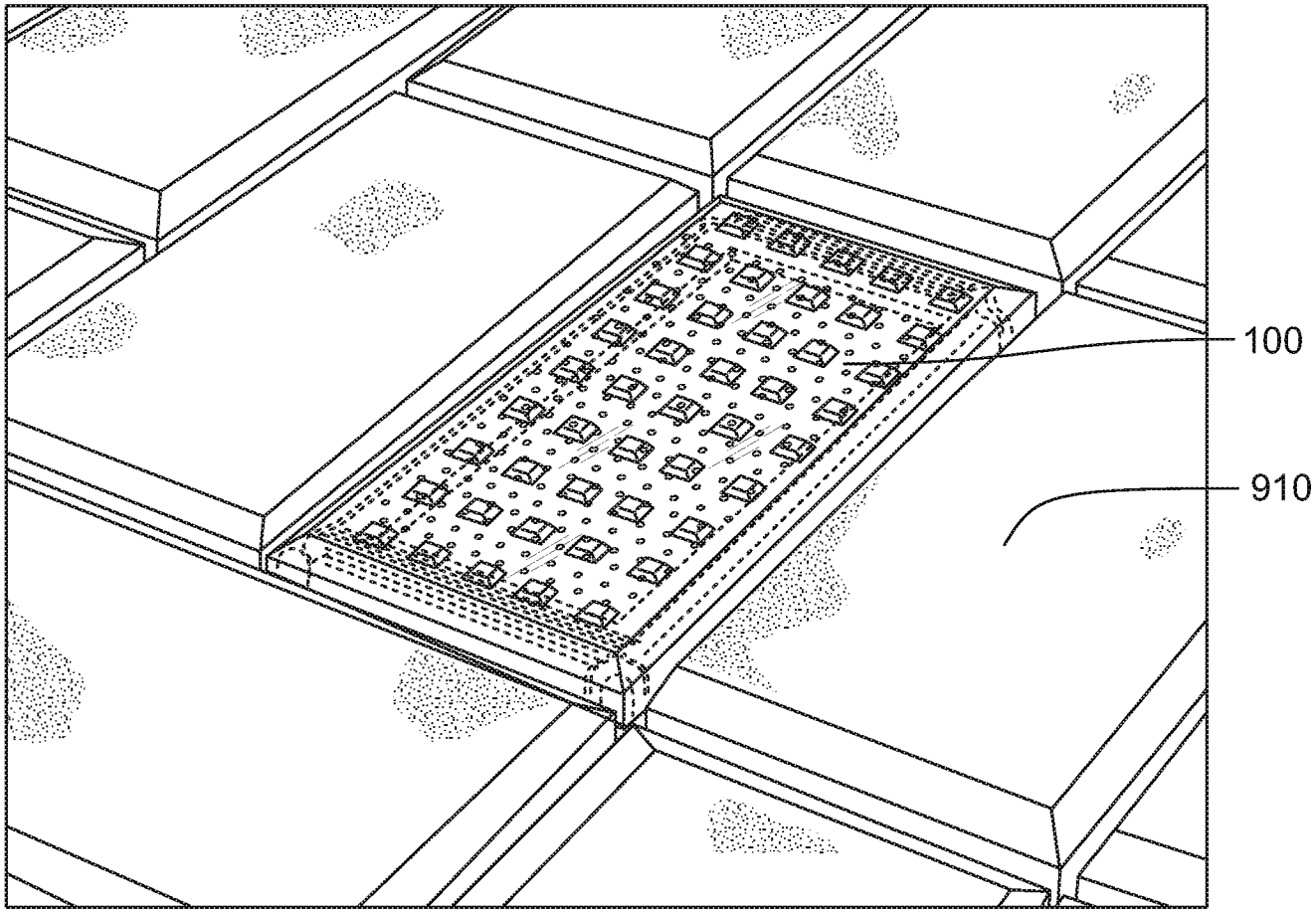
FIG. 9 illustrates the internally illuminated enclosure installed in a placesetter base that forms part of a walkway.

FIG. 9 illustrates the internally illuminated enclosure 100 installed in a placesetter base 420 that forms part of a walkway 910.

Figure 10:
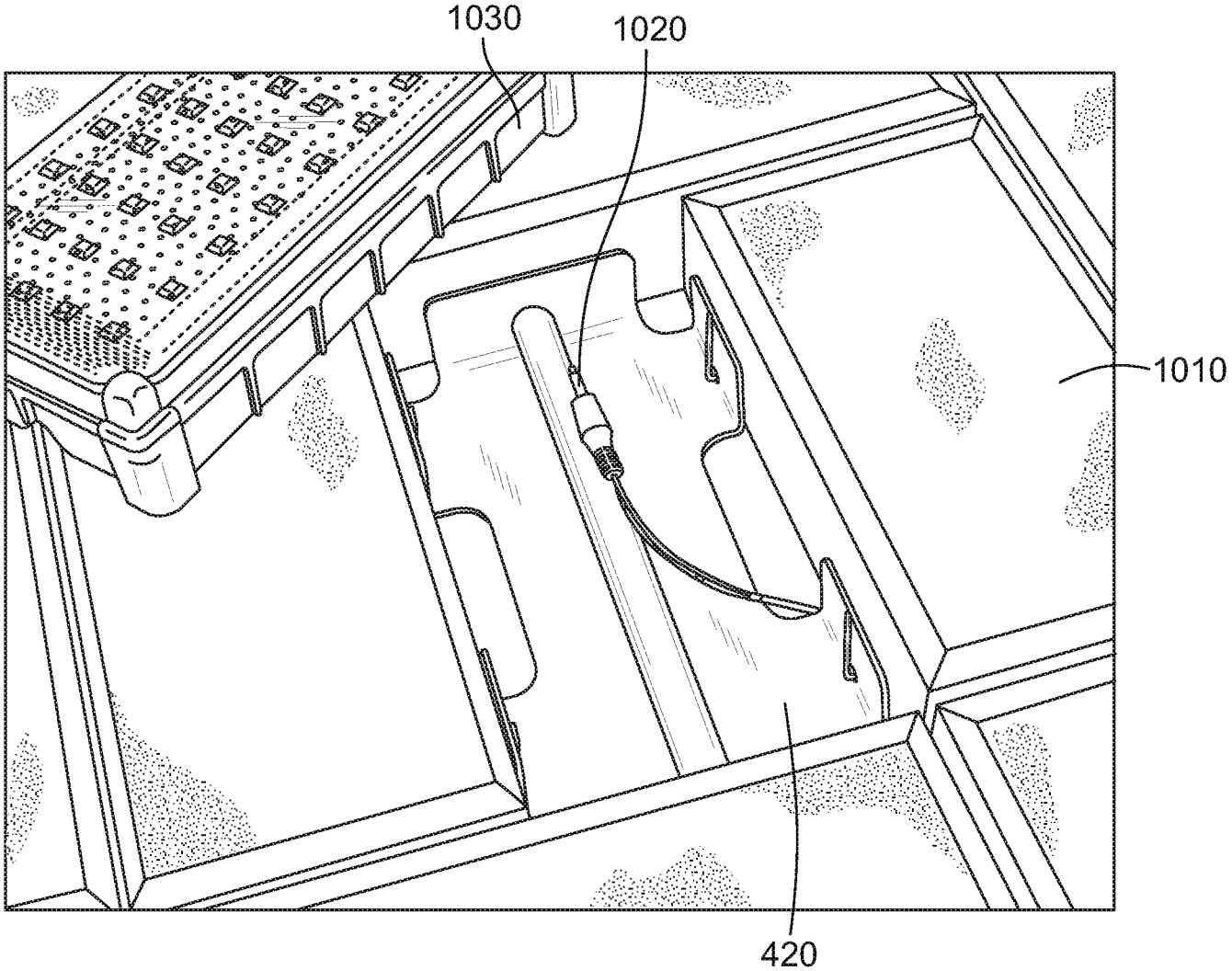
FIG. 10 illustrates an alternative embodiment with a powered internally illuminated enclosure.

FIG. 10 illustrates an alternative embodiment 1000 with a powered internally illuminated enclosure. More specifically, FIG. 10 shows masonry bricks 1010, a placesetter base 420, a power cord 1020, and a powered internally illuminated enclosure.

Although the internally illuminated enclosure 100 of FIG. 1 is only powered by electricity received from its solar panel, in an alternative embodiment, the internally illuminated enclosure may be provided with power from an external power source, preferably a DC power source. The external power provided may be used in addition to power received from the solar panel or alternatively, the solar panel may be eliminated from the internally illuminated enclosure and power only provided externally.

Alternatively, with regard to the rechargeable battery, it may be removed if power is provided exclusively externally. However, in other embodiments, the external power may simply be used to further recharge the battery when the sunlight is insufficient.

The external power source may be a conventional power source such as a wall outlet or may be an alternative power source such as an additional, larger solar array, for example.

Figure 11:
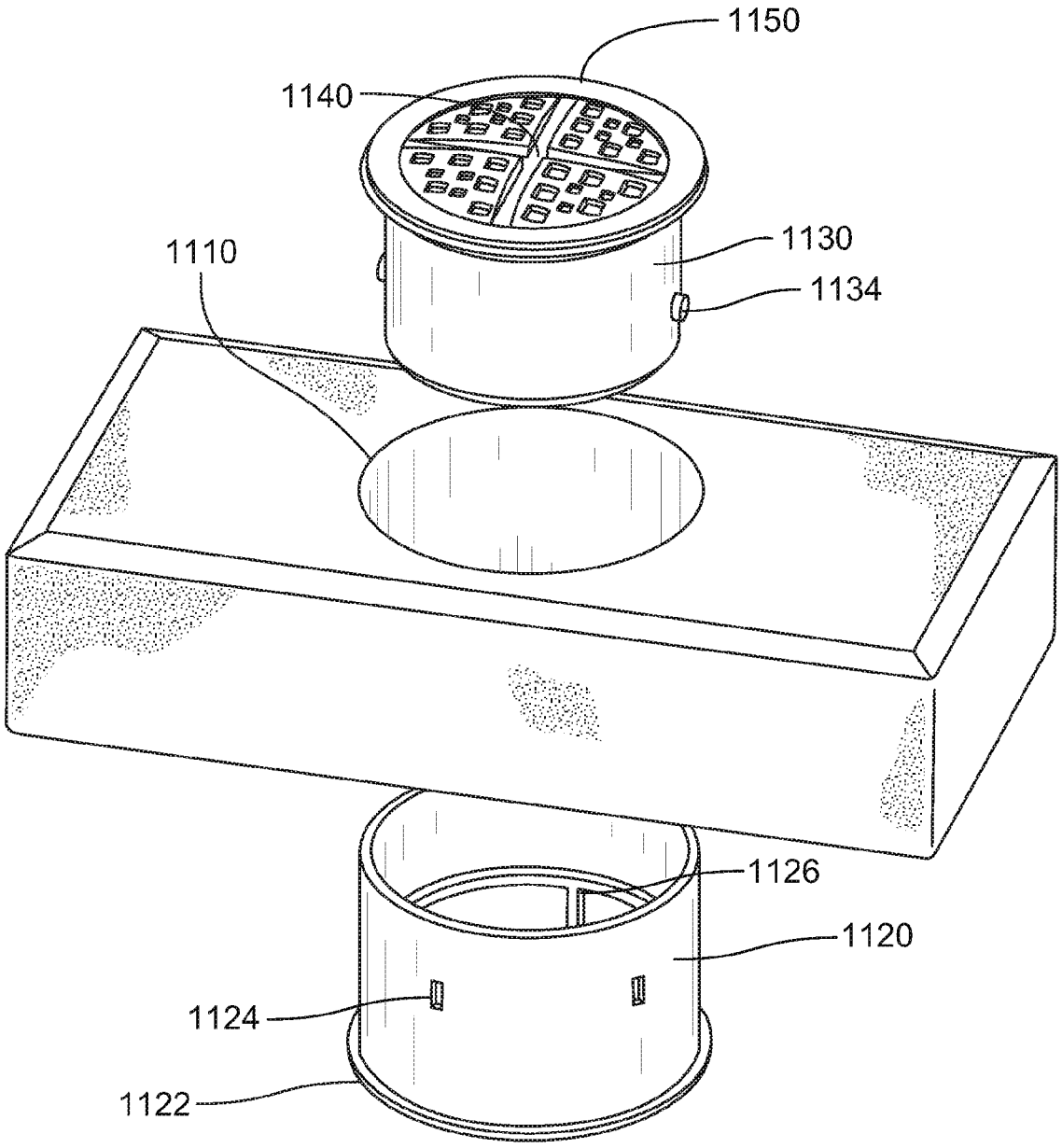
FIG. 11 illustrates an alternative embodiment of the internally illuminated enclosure.

FIG. 11 illustrates an alternative embodiment of the internally illuminated enclosure 100. FIG. 1 includes a manufactured paver stone 1110, a cylinder insert 1120, a bottom flange 1122, interference protrusions 1124, female bayonet locks 1126, a sealed solar cell 1130, a male bayonet lock 1134, cross slots 1140, and a light-permeable top 1150.

In operation, the manufactured paver stone 1110 has been manufactured to have a hole in its center to received the cylinder insert 1120. The cylinder insert 1120 is comparable to the placesetter base in the embodiment described above in that it is permanently placed in the masonry. The bottom flange 1122 of the cylinder insert 110 interacts with the bottom edge of the paver stone 1110 so that the cylinder insert 1120 does not completely enter the paver stone. Additionally, the interference protrusions 1124 mechanically lock the cylinder insert into the paver stone and prevent rotation of the cylinder insert.

Once the cylinder insert 1120 has been installed into the paver stone 1110, the sealed solar cell 1130 may be introduced into the top of the paver stone 1110 and thus into the interior of the cylinder insert 1120. Once the sealed solar cell 1130 has been introduced into the cylinder insert 1120, the male bayonet locks 1134 of the sealed solar cell 1130 interact with the females bayonet locks 1126 of the cylinder insert 1120 to lock the sealed solar cell 1130 into the cylinder insert 1120.

Additionally, the sealed solar cell 1130 includes rechargeable batter storage and LEDs that may be turned on an off using an ambient light sensor or other photo sensor and switch as described above with regard to the preferred embodiment. Also, the light-permeable top 1150 preferably includes a solar element positioned under it to convert sunlight to electricity as described above, as well as the ambient light sensor.

Also, the top preferably includes cross slots 1140, or another recessed shape, to facilitate turning of the top in order to remove the top to provide access to the interior of the sealed solar cell.

Figure 12:
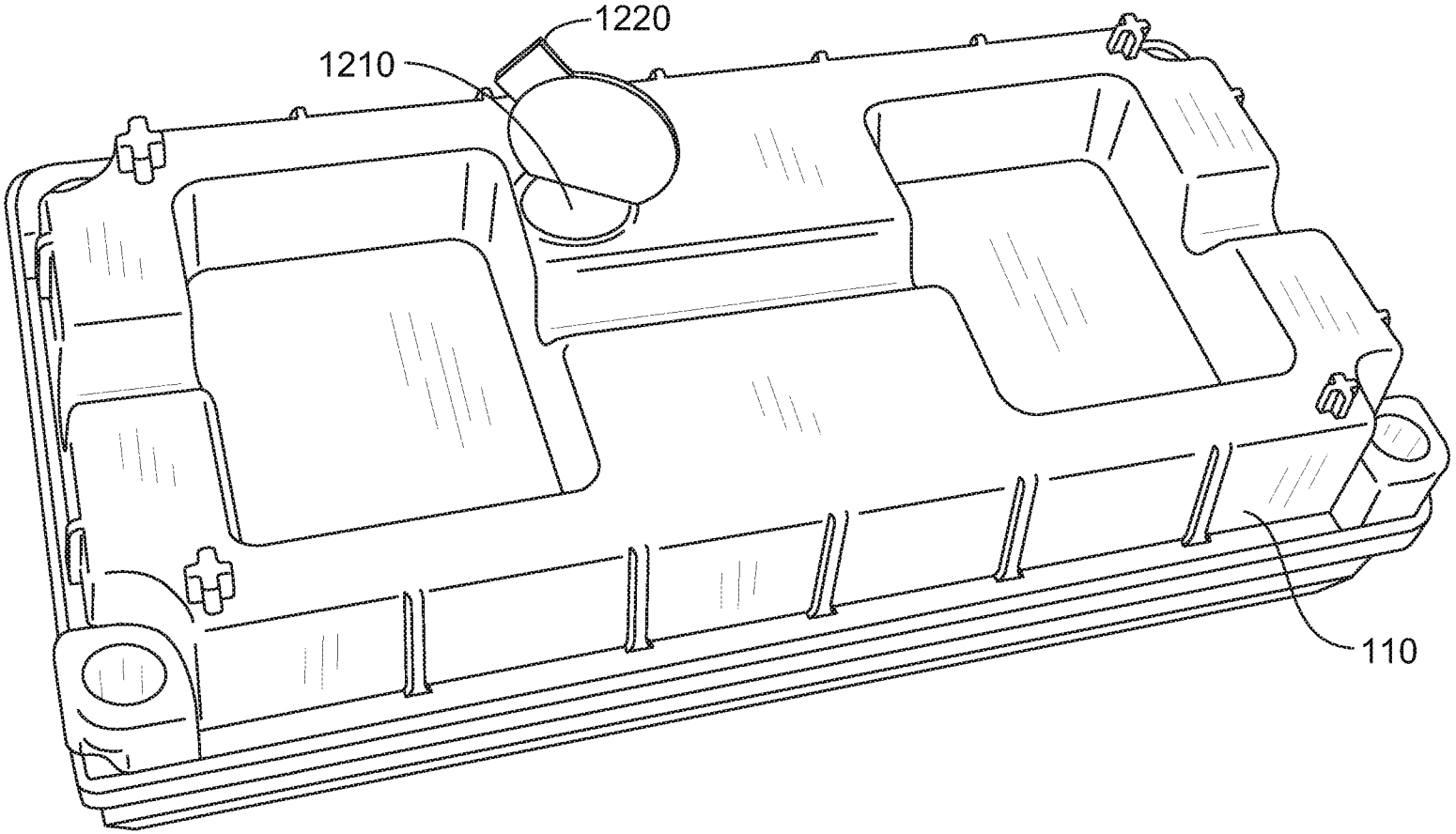
FIG. 12 illustrates an embodiment of the primary base prepared for initial transportation to the user.

FIG. 12 illustrates an embodiment of the primary base 110 prepared for initial transportation to the user. As shown in FIG. 12, the primary base 110 include a magnetic slug 1210 and a pull tab 1220.

In operation, the primary base 110 is shipped as a sealed unit with a battery that is made to go on and off by light exposure. As shown in FIG. 12, magnetic slug is preferably taped (with the tape having a pull tab 1220) to the primary base 110 which resides adjacent to an internal magnetic switch. When the customer installs the lighted element, they remove the pull tab 1220, tape, and slug 1210 to allow the unit to function.

Thus, one or more embodiments of the present invention comprise an internally illuminating, electric powered lighting device that assumes the shape and role of a Paving stone or brick for walking or driving upon and a product thereof that is integrated into walkways and driveways and other architectural constructions for auxiliary lighting and illumination from within.

Additionally, although, as mentioned above, it is difficult and not advised to attempt to remove and replace an individual brick within the matrix. And as these constructions are considered to be permanent, due to the materials used, it is not common to remove and/or replace individual brick elements unless there is damage and repair is necessary. However, one or more embodiments of the present invention allow the internally illuminated enclosure to be replaced—repeatedly if necessary—without disturbing the individual brick matrix.

In accordance with one or more embodiments of the present invention, it is obvious to even the casual observer that when strategically located Paver stones within the surface matrix are illuminated, the surface, either for walking or driving, becomes easier and safer to navigate at night.

The preferred embodiment of the invention we present herein is based on an integral solar collection and battery storage method of providing power to an LED in selective ambient light conditions and as automatically controlled by programmed sensors. Alternative embodiments comprise direct wired LED lighting elements.

The integral solar powered product in the preferred embodiment contemplates the fundamental reality that while Paver surfaces are intended to be permanent, the currently available illumination products, are not. Even if advertised as permanent or long life products, there are a number of technological limitations to the longevity of current solar lighting products, borne in either the fundamental construction of the solar collector cell, the storage batteries, circuitry, or general enclosure materials utilized. Perhaps many or all of these shortcomings may be overcome with the highest of quality materials, however the cost may be prohibitive.

Therefore, one or more embodiments of the present invention provide an illumination product for outdoor installation that is affordable, however successfully accomplishing the correct integration of permanent components and temporary components. One or more embodiments of the present invention herein seek to introduce a secondary component to the primary solar illuminating enclosure which is called a "Placesetter". The Placesetter is made to be semipermanent and takes it's place as an individual brick within the original construction of the Paver surface matrix. The Placesetter is a two-piece assembly comprising a Top and what we call the Secondary Base.

Within the Paver design and installation, Placesetters assume the positions where illumination is desired. After completion of the installation, the Top component of the Placesetter may be removed leaving the Secondary Base in place with the stone matrix. This allows attachment of the primary solar illuminating enclosure to the Secondary Base, replacing the Placesetter Top, and becoming an apparent integral stone within the matrix.

However, the interchangeability to the Placesetter Secondary Base facilitates removal of the primary solar illuminating enclosure when necessary for repair or replacement, while not upsetting the matrix construction.

An alternate embodiment of this construction provides a locking mechanism whereby detachment from the Secondary Base requires a security key.

The preferred embodiment of the invention comprises an internally illuminated device that is powered by solar energy and performs as an independent cordless light source. Using a light sensor, the unit is programmed for automatic On and Off based on the ambient light brightness. An alternate method is to control the On time by ambient light sensing and allowing a prescribed On duration by an electronic timing circuit. A n alternate embodiment of the Paver product utilizes wiring from the device to a central power source, such as a home electrical circuit. In the latter case, additional power transformers may be required external to the Paver device.

Because the Placesetter component of the invention is constructed and installed as a permanent member of the surface matrix, it also may be utilized in a contiguous concrete or asphalt surface. In fact, a poured, or layed contiguous walkway or driveway surface makes it quite impossible to remove and replace an integrated lighting segment unless the secondary permanent base of one or more embodiments of the present invention was employed.

Additionally, an option in sand constructions is to also fill the adjacent joints between the Paver elements with sand.

The Placesetter is preferably designed to replicate the size and shape of the particular size of stone it will integrate with. Due to the several different standard sizes of stone pavers, several different sizes of placesetters—matching the pavers—may be employed.

Additionally, in an alternate design of the placesetter base, the corner tabs may be broken away if not needed, or are presenting interference, or are otherwise undesired.

Further, one or more of the embodiments of the invention provide an illumination device that comprises a primary base housing and an optically clear top housing as joined together to form a sealed and waterproof enclosure, and within said enclosure residing a solar collector, storage battery, light sensor and Light Emitting Diode with electrical circuitry that will cause the light to go on in diminished external ambient light and go off in abundant external ambient light, and a optically clear lens with intermittent surface roughening to allow the light emitted from the Light Emitting Diode to be projected in a uniform manner across said lens surface and projected outward from said lens surface and through the optically clear top housing, and said sealed and waterproof enclosure having a secondary base external to the primary base and allowing mechanical attachment to said primary base and said secondary base possessing a top allowing temporary installation whereby removal of secondary top allows of mechanical attachment of said primary base, whereby the secondary base serving to provide a means of permanent installation for the lighting device and it's entirety, and whereby facilitating the removal and replacement of the primary enclosure and not compromising the integrity of the overall installation.

Additionally, whereby the primary illumination enclosure is a snap fit attachment to the secondary base. Additionally, whereby the detachment of the primary enclosure from the secondary base is performed by a special mechanical tool. Additionally, whereby the primary illumination enclosure is attached to and detached from the secondary base by a quarter-turn bayonet lock. Additionally, with a primary top and a primary base assembly that creates a sealed and waterproof enclosure.

Alternatively, one or more of the embodiments of the present invention provide a solar powered internal illumination device enclosed within a primary top and a primary base and said device having a secondary externally detachable base, the assembly in total used for the purpose of illumination in walkway and driveway surfaces and whereby possessing like physical dimensional attributes to the elements comprising the overall construction and whereby becoming integral components within the collective matrix of the construction, and with said secondary base component allowing permanent installation within said matrix of surface elements and thereby facilitating removal and replacement of the primary illumination enclosure.

Additionally, whereby the primary illumination enclosure is an internally illuminated self powered solar light. Additionally, whereby the primary illumination enclosure is a solar powered lighting device and utilizing an ambient light sensor to automatically be turned on and off. Additionally, whereby the primary illumination enclosure is a solar powered lighting device and utilizing an ambient light sensor to automatically be turned on and an electronic means of timing to automatically be turned off.

Further, one or more of the embodiments of the present invention provide a secondary base housing and said secondary base allowing attachment of a secondary top and whereby the assembly replicates the dimensional attributes of a specific stone or brick and may installed within a multiple stone construction and replicating the position of typical stone within the construction and allowing said secondary base installation to be permanent, and secondary top attachment to be temporary, and the removal of said secondary top to allow replacement with an alternate top and not altering or upsetting the aggregate construction.

Additionally, whereby the secondary top is replaced with an internally illuminated lighting enclosure. Additionally, whereby the internally illuminated light enclosure is solar powered.

Also, one or more of the embodiments of the present invention provide an interlocking base and top enclosure that replicates the size and shape of a masonry product that is used in the construction of a walkway, driveway or wall, and whereby the said interlocking base and top may be utilized as a substitute for a singular masonry product within said masonry construction and whereby the top of the enclosure can be removed after construction, and replaced with an alternate top, such as one possessing a lighting element.

Additionally, whereby the alternate top is an internally illuminating solar powered light device.

Further, one or more of the embodiments of the present invention provide an internally illuminating solar powered lighting enclosure with a primary base integrally and an optically clear primary top, said primary base and primary top sealed together so as to provide a waterproof enclosure, and said primary base allowing the mechanical interlocking assembly to an external secondary base, and whereby the overall size and shape of said interlocking assembly replicates the size and shape of a masonry product used in walkway, driveway, or wall constructions and whereby said interlocking assembly can be selectively substituted for individual masonry components within the construction for lighting and decoration purposes.

Additionally, whereby the interlocking assembly allows permanent installation of the secondary base, and temporary installation of the internally illuminating solar powered lighting enclosure, whereby said internally illuminating solar powered lighting enclosure may be removed and replaced at will.

Additionally, one or more embodiments of the present invention provides a general internally illuminated walkway/roadway lighting product that runs automatically by stored solar energy and fits directly into the scheme of other standard structural walkway or roadway or wall construction elements. The fact that we are able to illuminate within the same aperture as which we collect solar energy may be unique. We have LED's along 2 edges that project light across the face of the part using refraction through surface protrusions and interruptions, for example, the Fresnel effect.

Additionally, one or more embodiments of the present invention provides replaceable "Placesetter" components. Some unscrupulous dealers are selling and installing "lighted solar products" as permanent within the total installation, which is not true as based on battery and solar panel technological limitations. As some point far before the useful life of the walkway is up (decades), the battery, solar, and other components will need replacement. In these situations, removal and replacement may be extremely difficult, therefore the "placesetter" approach presented above is a great improvement. This also helps protect the lighted component during the rugged installation process as the protective placesetter cover is removed after installation and replaced by insertion of the lighted element.

Additionally, one or more embodiments of the present invention provides a product that becomes an integral component within the installation, that is just another brick in the wall, walkway or roadway, typically assuming a like brick size, or of manufactured dimensions that will work within the geometric pattern of a specific stone size.

Of further note in the preferred (and alternate) embodiment is that the bottom component of the "placesetter" may be changed to accommodate different stone thicknesses (such as depths) without changing the lighted element. This is manifest in a situation for example where we have a common paver brick that is approx. 4"×8" and 4" thick, however a Holland Paver is approx. 4"×8"×3" thick. By modifying the placesetter base only, we may accommodate both paver styles.

Additionally, one or more embodiments of the present invention provides matching the size and shape of the paver stones within the geometric design of the installation as it mimics another brick. However the alternate embodiment is based on a more standard size lighted element that is adapted to a brick in the manufacturing process, that is, a round through hole or other shaped aperture is manufactured into the brick to accept placesetter and solar lighted element. For paver products made from casting a concrete product, such an aperture may easily be manufactured into the brick by changing the casting. Additionally, cutting (drilling) a round hole through the stone after the fact is also very possible. In the alternate embodiment, the "placesetter" component essentially becomes the bottom insert that is pushed and mechanically attached into the formed aperture from the bottom prior to installation. The upper lighted element may be attached, (screw, bayonet, or other) and interchanged on demand, or a dummy blank element might also be used if lighting is not desired.

In addition to the embodiments discussed above wherein the internally illuminated enclosure is included as part of a walkway or driveway, the internally illuminated enclosure may also be incorporated into other building materials. For example, the internally illuminated enclosure may be installed in a brick wall on an inside or outside surface. Alternatively, the internally illuminated enclosure may be included in other outdoor or indoor structures, especially structures made from bricks. For example, a brick or stone bench on a patio may include one or more bricks replaced by internally illuminated enclosures. Additionally, a brick retaining, architectural, or landscape structure or wall may also include one or more internally illuminated enclosures.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

The invention claimed is:

1. An internally illuminated enclosure assembly for use with a paver construction including a plurality of paver stones, the internally illuminated enclosure assembly comprising:

a placesetter including:

a placesetter base having at least one mounting tab extending laterally outwardly from a bottom of the placesetter base and configured for insertion beneath an adjacent paver stone; and a placesetter top configured for removable coupling to the placesetter base, the placesetter top extending over the placesetter base when coupled to the placesetter base; and an internally illuminated enclosure including:

a primary base configured for removable coupling to the placesetter base when the placesetter top is removed from the placesetter base;

a light-permeable primary cover coupled to the primary base, the primary base and primary cover defining a receptacle;

a solar panel disposed within the receptacle and positioned to receive light penetrating the light-permeable primary cover;

a rechargeable battery disposed within the receptacle, electrically connected to the solar panel, and configured to receive and store power from the solar panel;

an ambient light sensor disposed in the receptacle and configured to detect a light level through the light-permeable primary cover, the ambient light sensor transmitting a control signal when the light level is less than a predetermined threshold;

at least one lighting element disposed within the receptacle and configured to emit light when receiving a power flow; and a control circuit disposed within the receptacle and operably coupled to the rechargeable battery, the ambient light sensor, and the at least one lighting element, the control circuit configured to permit power flow from the rechargeable battery to the at least one lighting element when the control circuit receives the control signal.

2. The internally illuminated enclosure assembly of claim 1, wherein the light permeable primary cover includes a light permeable aperture.

3. The internally illuminated enclosure assembly of claim 2, wherein the light permeable aperture is configured to permit light to impinge on both the solar panel and the ambient light sensor.

4. The internally illuminated enclosure assembly of claim 1, wherein:

the at least one lighting element is configured to produce a first level of light associated with a first power flow and a second level of light associated with a second power flow;

the ambient light sensor is configured to generate a first control signal in response to a first predetermined ambient light threshold and a second control signal in response to a second predetermined ambient light threshold; and the control circuit is configured to transmit the first power flow in response to the first control signal and the second power flow in response to the second control signal.

5. The internally illuminated enclosure assembly of claim 1, wherein the at least one lighting element is configured to emit light in a plurality of colors.

6. The internally illuminated enclosure assembly of claim 1, further including an internal switch operably coupled to the control circuit and configured to selectively power on and off the at least one light source, the internal switch being magnetically responsive to actuate between on and off positions.

7. The internally illuminated enclosure assembly of claim 1 wherein the light emitted by the lighting element is emitted through the light permeable cover.

8. A method of installing an internally illuminated enclosure in a paver construction including a plurality of paver stones, the method comprising:

coupling a placesetter top to a placesetter base to form a placesetter assembly, the placesetter base including a mounting tab;

positioning the placesetter assembly with the mounting tab of a placesetter base inserted under an adjacent paver stone;

removing the placesetter top from the placesetter base;

after removing the placesetter top from the placesetter base, coupling a self-contained, pre-assembled, illuminated enclosure to the placesetter base, the illuminated enclosure including a primary cover coupled to a primary base to define a receptacle sized to receive a solar panel, rechargeable battery, ambient light sensor, at least one lighting element, and a control circuit.

9. The method of claim 8, wherein the plurality of paver stones is positioned prior to removing the placesetter top from the placesetter base.

10. The method of claim 8, wherein:

the solar panel is positioned to receive light penetrating the light-permeable cover;

the rechargeable battery is electrically connected to the solar panel and configured to receive and store power from the solar panel;

the ambient light sensor is configured to detect a light level through the light-permeable cover, the ambient light sensor transmitting a control signal when the light level is less than a predetermined threshold;

the at least one lighting element is configured to emit light when receiving a power flow; and the control circuit is operably coupled to the rechargeable battery, the ambient light sensor, and the at least one lighting element, and is configured to permit power flow from the rechargeable battery to the at least one lighting element when the control circuit receives the control signal.

11. An internally illuminated enclosure for use with a paver stone having a paver stone body defining a paver stone aperture, the internally illuminated enclosure comprising:

an insert sized for insertion into the paver stone aperture, the insert defining a receptacle and including at least one outwardly extending interference protrusion configured to mechanically lock with the paver stone body;

a light-permeable top coupled to the insert and extending over the receptacle;

a solar panel disposed within the receptacle and positioned to receive light penetrating the light-permeable top;

a rechargeable battery electrically connected to the solar panel and configured to receive and store power from the solar panel;

an ambient light sensor disposed in the receptacle and configured to detect a light level through the light-permeable cover, the ambient light sensor transmitting a control signal when the light level is less than a predetermined threshold;

at least one lighting element configured to emit light when receiving a power flow; and a control circuit operably coupled to the rechargeable battery, the ambient light sensor, and the at least one lighting element, the control circuit configured to permit power flow from the rechargeable battery to the at least one lighting element when the control circuit receives the control signal.

12. The internally illuminated enclosure of claim 11, wherein the light-permeable top is releasably coupled to the insert.

13. The internally illuminated enclosure of claim 11, wherein the insert includes a bottom flange extending below a bottom surface of the paver stone bottom bordering the paver stone aperture.

14. The internally illuminated enclosure of claim 11, further including an internal switch operably coupled to the control circuit and configured to selectively power on and off the at least one light source, the internal switch being magnetically responsive to actuate between on and off positions.

15. The internally illuminated enclosure of claim 11, in which the light permeable top, the solar panel, rechargeable battery, ambient light sensor, at least one lighting element, and control circuit are packaged in a sealed solar cell.

16. The internally illuminated enclosure of claim 15, in which the sealed solar cell is releasably mechanically locked to the insert.

17. The internally illuminated enclosure of claim 16, in which the light permeable top includes at least one cross slot for rotating the sealed solar cell relative to the insert.

* * * * *